United States Patent [19]

Theurer et al.

[11] Patent Number: 4,655,142

[45] Date of Patent: Apr. 7, 1987

[54] APPARATUS FOR CORRECTING THE LEVEL AND CROSS LEVEL OF A TRACK

[75] Inventors: Josef Theurer, Vienna; Gernot Bock, Aschach/Donau, both of Austria

[73] Assignee: Franz Plasser Bahnbaumaschinen-Industriegesellschaft m.b.H., Vienna, Austria

[21] Appl. No.: 620,145

[22] Filed: Jun. 13, 1984

[30] Foreign Application Priority Data

Nov. 16, 1983 [AT] Austria ..... 4036/83

[51] Int. Cl.[4] ..... E01B 29/04

[52] U.S. Cl. ..... 104/7.1; 104/8; 33/338

[58] Field of Search ..... 104/2, 7 R, 7 B, 12, 104/8, 7.1, 7.2; 33/1 Q, 287, 338; 73/146

[56] References Cited

U.S. PATENT DOCUMENTS

| | | | |
|---|---|---|---|
| 3,144,834 | 8/1964 | Stewart | 33/207 X |
| 3,298,105 | 1/1967 | Stewart et al. | 104/7 R X |
| 3,659,345 | 5/1972 | Plasser et al. | 104/7 R X |
| 3,735,495 | 5/1973 | Plasser et al. | 104/7 R X |
| 3,799,058 | 3/1974 | Plasser et al. | 104/7 R |
| 4,184,266 | 1/1980 | Hurni | 33/287 |
| 4,341,160 | 7/1982 | Nielsen | 104/7 B |
| 4,452,146 | 6/1984 | Bradshaw et al. | 104/7 R |

*Primary Examiner*—Randolph A. Reese

*Attorney, Agent, or Firm*—Kurt Kelman

[57] ABSTRACT

A track leveling, lining and tamping machine comprises a track lifting assembly, a leveling reference system associated with the track lifting assembly, the reference system including a reference line associated with each track rail, each reference line having a forward end and a rear end, a forward track sensing element supporting the forward end of the reference lines in an uncorrected track section, a rear track sensing element supporting the rear end of the reference lines in a corrected track section, and a level sensor associated with each track rail and supported on a corrected track section rearwardly of the track lifting assembly for measuring the level of each track rail with respect to the associated reference line, the level sensor generating a control signal responsive to the measured level, an element for measuring the cross level mounted on the rear track sensing element, the cross level measuring element generating a correction signal indicating any residual error in the desired cross level, a leveling control receiving the correction signal and the control signal, the control actuating the lifting drives of the track lifting assembly in response to the signals, and an adjustable device at the forward track sensing element for vertically adjusting the forward ends of the reference lines in response to a difference between the actual and desired cross level.

7 Claims, 2 Drawing Figures

APPARATUS FOR CORRECTING THE LEVEL AND CROSS LEVEL OF A TRACK

Figures 1, 2:
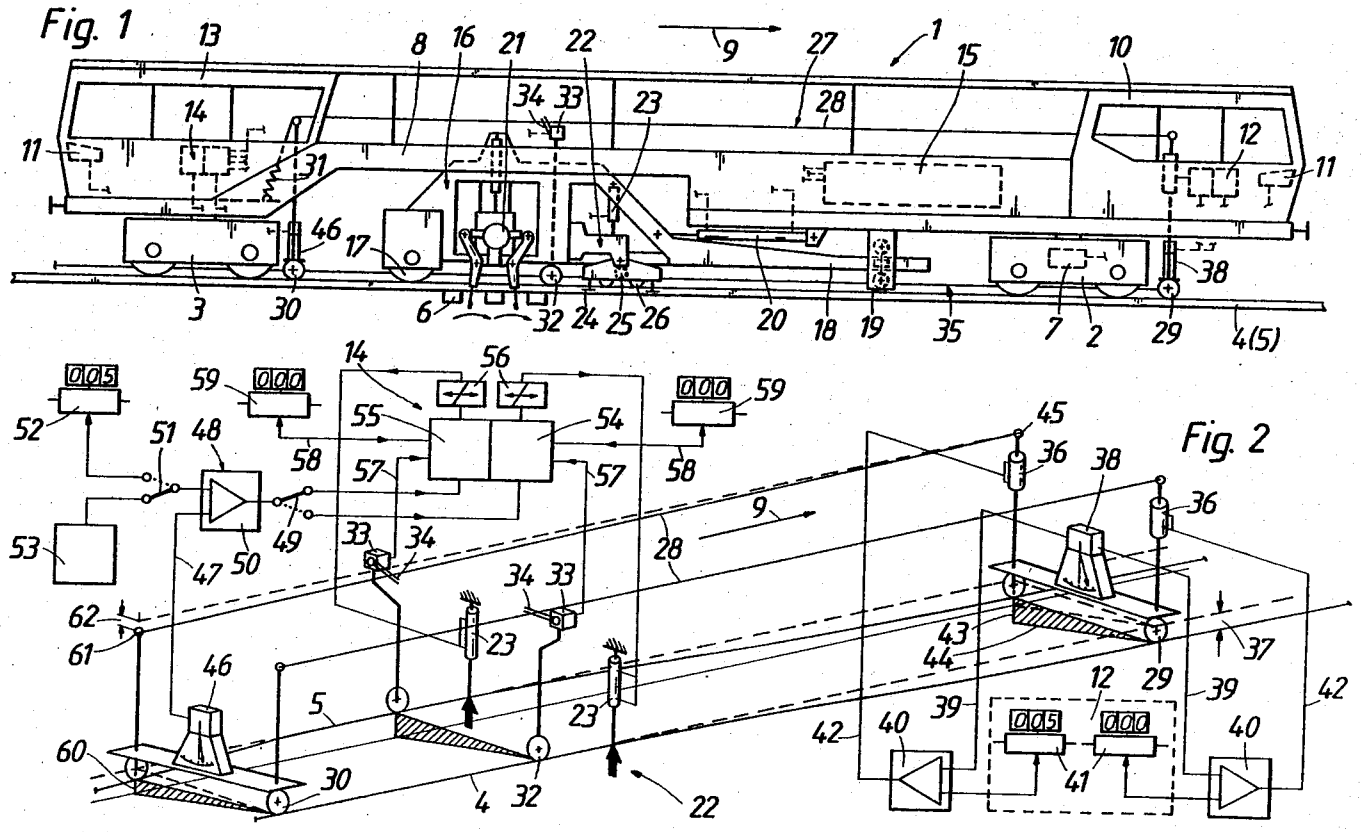

The present invention relates to improvements in a mobile apparatus for correcting the grade and cross level of a track having two rails, the apparatus being arranged for mobility along the track in an operating direction from successive corrected track sections to uncorrected track sections to be corrected. Such apparatus comprises a track lifting assembly including tools for engaging and lifting the track rails and a respective lifting drive connected to the tools and associated with each track rail, and a leveling reference system associated with the track lifting assembly. The reference system includes a reference line associated with each track rail, each reference line having a forward end and a rear end, in the operating direction, a forward track sensing element supporting the forward end of the reference lines in a respective one of the uncorrected track sections, a rear track sensing element supporting the rear end of the reference lines in a respective one of the corrected track sections, and a level sensor associated with each track rail and supported on a respective one of the corrected track sections rearwardly of the track rail engaging and lifting tool for measuring the level of each track rail with respect to the associated reference line, the level sensor generating a control signal responsive to the measured level. A leveling control receives the control signal, the control actuating the lifting drives in response to these signals. An adjustable device at the forward track sensing element vertically adjusts the forward ends of the reference lines in response to a difference between the actual and the desired cross level.

U.S. Pat. No. 3,799,058, dated Mar. 26, 1974, discloses a mobile track tamping and leveling machine wherein the forward ends of the two level reference wires are vertically adjustably arranged on a measuring bogie which senses the track level and carries an electrical cross level measuring element, the vertical adjustment being effected by electrically controlled adjustment drives. The drive motors are connected to a control circuit which constitutes a difference forming unit whose first input receives a signal corresponding to the actual cross level of the track sensed by the cross level measuring element and whose second input is connected to a signal emitter generating a signal corresponding to the desired cross level of the track. The basic lifting stroke, i.e. the extent to which the track is to be lifted to a desired grade, is imparted to the lifting drives of the track lifting assembly through a difference forming unit whose first input is connected to a track level sensor arranged in the range of the tamping means and whose second input is connected to a signal emitter generating a signal corresponding to the desired grade of each track rail. At the beginning of the operation, the forward end of the level reference line associated with the rail serving as grade rail is lifted to the desired basic track grade and the signal corresponding to the desired cross level of the other rail is generated. Therefore, the forward end of the level reference line associated with the other rail will always be held at the desired cross level of the other rail with respect to the grade rail because the electrically controlled adjustment drive will be actuated whenever there is a difference between the actual and the desired cross level. This arrangement has been very successfully used in many modern track leveling, lining and tamping machines. However, under particularly adverse track conditions, such as when the track yields because of poor ballasting, residual errors occur in the desired cross level of the leveled track and this results in ultimate inaccuracies in the track position.

U.S. Pat. No. 3,659,345, dated May 2, 1972, discloses a mobile track surfacing apparatus operating with an optical reference system for correcting the level and cross level of a track. The level reference lines are light beams emitted from senders vertically adjustably mounted on a front bogie and projecting light beams associated with each rail to light-sensitive receivers mounted on rear track level sensors, shadow boards being arranged in the paths of the light beams intermediate the senders and receivers. In this apparatus, too, the forward end of the level reference line associated with the other rail will always be held at the desired cross level of the other rail with respect to the grade rail because the electrically controlled adjustment drive will be actuated whenever there is a difference between the actual and the desired cross level. A cross level measuring control element in the range of the rear track level sensor makes it possible to correct any residual track cross level errors. This apparatus has also been successfully used but has found practical application primarily in very large, high-efficiency machines because optical reference systems are considerably more expensive to construct and operate than reference wire systems.

U.S. Pat. No. 3,298,105, dated Jan. 17, 1967, also discloses an optical system for monitoring the level of a track. A transmitter of a cone-like high frequency beam is fixedly arranged on a front bogie to project the beam past shadow boards mounted at the front end of the machine in the range of track lifting tools on light-sensitive receivers associated with each rail. The receivers are vertically adjustably mounted on a frame supported on the rear undercarriage of the machine and motor-operated spindle drives adjust the receivers at a desired height. A cross bar links the two receivers and carries a gravity pendulum equipped with switches. The switches operate the motors and are so arranged that they are open when the pendulum is in its neutral position and the cross bar extends horizontally. In case of a superelevation of the track, the switch associated with the higher track rail is closed and the motor-driven spindle lowers the associated receiver until the pendulum returns to its neutral or rest position. Thus, the transmitter and the two receivers define a transverse reference plane which is maintained in a horizontal position for controlling the operation of the track lifting tools. To enable the grade rail to be changed from one side to the other when the direction of a curve changes, a second transmitter is arranged on the front bogie for selective alternate operation. This system requires relatively expensive optical and electrical apparatus and has the additional disadvantage that cross level changes often cause unwanted switching and vertical adjustments of the receivers because the operating tools on the machine transmit their impacts and vibrations to the pendulum. Furthermore, such switches wear out easily and deteriorate rapidly.

Another optical system for controlling grading and cross leveling of a track is disclosed in U.S. Pat. No. 4,341,160, dated July 27, 1982. It differs from that of U.S. Pat. No. 3,659,345 by the arrangement of each light-sensitive receiver for vertical adjustment in relation to the track sensor on which the receivers are mounted. Cross level measuring elements are mounted on the front and rear track sensing elements and are connected by control and vertical adjustment devices to the vertical adjustment drives of the transmitters and receivers. The drives are so controlled that both receivers and both transmitters assume vertical positions corresponding to the set cross level. The two reference beams extending between the associated transmitters and receivers and associated with the respective track rails, therefore, lie in a plane parallel to the desired cross level. The shadow boards cooperating with the reference beams are arranged at a fixed distance above each rail. While the patent alleges an improved operating accuracy, this must be balanced against the high expenses connected with the control system involving four vertical adjustment drives, increased maintenance costs and tendency to malfunction, not to speak of the inaccuracies resulting from the multi-part structure of the sensing elements.

It is the primary object of this invention to improve a mobile apparatus for correcting the grade and cross level of a track, such as a track leveling, lining and tamping machine, of the first-described type so that it has an even higher operating accuracy.

In such an apparatus, this and other objects are accomplished according to the invention by mounting an element for measuring the cross level on the rear track sensing element. The cross level measuring element generates a correction signal indicating any residual error in the desired cross level and the leveling control actuates the lifting drives in response to the correction signal received from the cross level measuring element and the control signal received from the level sensor.

Such an apparatus for correcting the grade and cross level of a track for the first time does away with a mechanical vertical adjustment of the level reference lines during the operation to compensate for any residual cross level errors, and makes it possible to influence the level control directly and electronically to eliminate any residual cross level errors produced in the graded track so that the track lifting drives are automatically controlled in response not only to the level control signal but also the correction signal indicating any residual cross level error. This eliminates all sources of errors which are unavoidable in mechanical vertical drives for adjusting the level of the reference lines, such as tolerances between interacting parts, wear and inertia of parts, etc. In addition, the structure is simplified and correspondingly less prone to malfunction while greatly improving the operating accuracy of the apparatus in correcting the grade and cross level of a track. The operation of the system also is much easier than in known apparatus. It is an added advantage of the apparatus that it may be readily retro-fitted with little cost on existing track surfacing machines equipped with track grading apparatus.

The above and other objects, advantages and features of the invention will become more apparent from the following detailed description of a now preferred embodiment thereof, taken in conjunction with the accompanying, generally schematic drawing wherein FIG. 1 is a side elevational view of a track leveling, lining and tamping machine incorporating the apparatus of the present invention, and FIG. 2 is a greatly simplified perspective view of the leveling reference system of the machine of FIG. 1, including a simplified circuit diagram of the control circuit.

Referring now to FIG. 1, there is shown mobile apparatus 1 for correcting the grade and cross level of a track having two rails 4, 5 fastened to ties 6. The illustrated apparatus is a continuously advancing track leveling, lining and tamping machine arranged for mobility along the track in an operating direction indicated by arrow 9. The machine has main frame 8 mounted on swivel trucks 2, 3 and propelled by drive 7. Operator's cab 10 is mounted at the front end of machine frame 8 and houses control panel 11 for drive 7 as well as input and indicating instruments 12 for various track parameters, such as cross level, radius of curve, etc. Another operator's cab 13 is mounted at the rear end of machine main frame 8. In addition to control panel 11 and the controls for the various operating tools of the machine, this cab also houses track leveling control 14 which will be described hereinafter. Power plant 15 of machine 1 is mounted in the front range of machine frame 8.

Subframe 16, which carries the operating tools, has a rear end supported on the track rails by a set of flanged wheels 17 to guide the subframe along the track while the front end of the subframe is constituted by two longitudinal beams 18 extending above track rails 4, 5 and longitudinally adjustably as well as pivotally supported in vertical and horizontal roller bearing guides 19. Longitudinal adjustment drive 20 connects subframe 16 to main frame 8, the ends of drive 20 being linked to the subframe and main frame, respectively, by universal joints. Conventional tamping units 21 are vertically adjustably mounted on subframe 16 adjacent supporting and guiding wheels 17. Conventional track lifting and lining assembly 22 is mounted on the subframe ahead of the tamping units, in the operating direction, and includes tools 24, such as clamping rollers, for engaging and lifting the track and a respective lifting drive 23 connected to the tools and associated with each rail. For lining, the assembly has flanged lining rollers 26 laterally displaceable by lining drives 25.

Machine 1 is equipped with leveling reference system 27 associated with track lifting and lining assembly 22 and including, as conventional, a reference line 28 associated with each track rail 4, 5, each reference line having a forward end and a rear end, in the operating direction indicated by arrow 9. Forward track sensing element 29, preferably guided along the track rails by flanged wheels, supports the forward end of the reference lines in an uncorrected track section and rear track sensing element 30 is guided by flanged wheels along a corrected track section and supports the rear end of the reference lines. Spring arrangement 31 in rear operator's cab 13 serves to tension reference lines 28 which are wires. Level sensor 32 associated with each track rail 4, 5 is arranged on subframe 16 between tamping units 21 and track lifting and lining assembly 22 in the corrected track section rearwardly of track rail engaging and lifting tools 24 for measuring the level of each track rail with respect to associated reference line 28. As is also conventional, the level sensors have rotary potentiometers 33 whose fork-shaped sensing member is arranged to engage the reference wires for generating a control signal responsive to the measured level. Lining reference wire system 35 for controlling the lining of the track is merely schematically indicated, the lining reference wire extending from front track sensing element 29 to a further track sensing element arranged rearwardly of machine 1.

All of the above-described structure and the operation of such a machine are known and are, therefore, not described in detail. Main machine frame 8 advances non-stop at a substantially constant speed in the direction of arrow 9 while subframe 16 is moved intermittently from tamping cycle to tamping cycle by drive 20. However, the mobile apparatus of the present invention may be used, of course, with intermittently advancing tampers.

As will be seen from the perspective view of FIG. 2, the apparatus comprises an adjustable device at forward track sensing element 29 for vertically adjusting the forward ends of reference lines 28 in response to a difference between the actual and the desired cross level. The illustrated adjustable device includes schematically shown drives 36 associated with track rails 4, 5 to enable the forward reference line ends to be vertically adjusted with respect to track sensing element 29. Drives 36 may be, for example, spindle drives operated by reversible electro-motors to lift the forward reference line ends by distance 37 corresponding to the basic lifting stroke, i.e. the vertical difference between the grade of the uncorrected track section shown in full lines and the desired grade of the corrected track section shown in broken lines. As shown in FIG. 1, the input and indicating instrumentation 12 is connected to drives 36 so as to control the vertical adjustments of the two forward reference line ends also with respect to the desired cross level. For this purpose, cross level measuring element 38 constituted by an electronic pendulum is arranged on track sensing element 29 and lines 39 connect the outputs of the electronic pendulum, respectively, to one input of a signal difference forming unit 40 respectively associated with each track rail to transmit a signal corresponding to the actual cross level to the inputs of the signal difference forming units. The second inputs of signal difference forming units 40 are connected with respective input element 41 transmitting thereto a signal corresponding to the desired superelevation of one or the other rail with respect to the selected grade rail. The outputs of signal difference forming units transmit a signal corresponding to the difference between the two input signals through lines 42 to drives 36.

The portion of the control circuit described hereinabove operates as follows in the case of the illustrated track position conditions:

After basic lifting stroke 37 has been set and one of the rails, for example track rail 4, has been selected as the grade rail, a signal corresponding to superelevation 43 of the other track rail 5 in relation to rail 4 and horizontal plane 44 passing through rail 4 is stored in signal input element 41. The superelevation is obtained from a track plan for the track section which is to be corrected and is assumed to be constant over the length of this track section. This signal corresponding to the desired superelevation is compared in associated signal difference forming unit 40 with the signal received therein from electronic pendulum 38 which measures the actual cross level, and the differential signal corresponding to the cross level error is transmitted through line 42 to vertical adjustment drive 36 which continuously corrects forward end 45 of reference line 28 associated with rail 5 in response to any error signals. The control circuit portion associated with grade rail 4 remains inoperative until the grade rails are changed, which happens when a track curve changes direction.

The portion of leveling control 14 according to this invention has been schematically shown in highly simplified form on the left side of FIG. 2. As illustrated, element 46 for measuring the cross level is mounted on rear track sensing element 30 and this cross level measuring element also is an electronic pendulum which has a single output transmitting a correction signal corresponding to positive or negative cross level measuring values indicating any residual error in the desired cross level. Line 47 connects the output to correction member 48 which receives the correction signal generated by the electronic pendulum and is connected to level sensors 33 for adjusting the electrical zero point thereof. The leveling control actuates lifting drives 23 in response to the control signals generated by the level sensors in response to the measured level and in response to the correction signals generated by cross level measuring element 46. The illustrated correction member is signal difference forming unit 50 having two inputs and an output, and its output is connected to leveling control 14 by selection switch 49. Line 47 transmits the correction signal from cross level measuring element 46 to one of the inputs while the other input receives a signal corresponding to a desired cross level. For this purpose, selection switch 51 selectively connects this other input to manually operable signal input device 52 or computer 53 wherein the desired cross level values of successive track sections to be corrected are stored. The output of signal difference forming unit 50 emits a signal corresponding to the difference between the two input signals and the emitted signal corresponds to the desired cross level of a respective track rail. Leveling control 14 has two inputs selectively receiving the emitted signal for lifting the respective track rail, the input being selected by operation of selection switch 49, depending on which rail is used as the grade rail in relation to which the level of the other rail is to be adjusted to eliminate any residual error in the desired cross level. For this purpose, the leveling control has to control units 54 and 55 respectively associated with a respective track rail. In the illustrated example, track rail 4 is the grade rail and signal difference forming unit 50 is connected with leveling control unit 55 associated with track rail 5, as shown by the position of switch 49 in full lines. The outputs of leveling control units 54, 55 are connected by respective servo valves 56 to respective lifting drives 23 connected to track lifting and lining assembly 22 shown only symbolically by arrows in FIG. 2. In addition, lines 57 connect the leveling control units 54, 55 to associated level sensors 33 to receive the control signals therefrom. Additional lines 58 connect the leveling control units to adjustment elements 59 for setting a zero electrical point of the respective control unit.

The illustrated control circuit makes use of the conventional track level control systems using reference wires and, because of its simplicity, is very dependable in operation. Since the zero point correction of the level sensors is effected before lifting and tamping the track, the operation proceeds very rapidly since the control of the track lifting drives need not be corrected during the lifting cycle and the lifting drive associated with each rail is switched off exactly and without any delay at the moment the level sensor cooperating with the respective reference wire indicates the desired value pre-corrected by the zero point adjustment. The use of a signal difference forming unit as correction member provides a very dependable electronic control circuit which has proved itself in practice. The selective connection of this unit to a manually operable signal input device or a computer in which the desired cross level values are stored offers the possibility of manually controlling the operation on the basis of desired cross levels marked along the track or fully automatically controlling the same on the basis of fixed data determined by a track plan and which may be transmitted in dependence on the advance of the machine along the track, which is measured by an odometer usually found on track leveling, lining and tamping machines.

In the illustrated embodiment, rear track sensing element 30 equipped with cross level measuring element 46 is arranged in the range of rear undercarriage 3 of track leveling, lining and tamping machine 1 and the magnitude of the adjustment of the electrical zero point of level sensors 33 corresponds to the residual cross level error reduced in the ratio of the distance between level sensors 33 and forward track sensing element 29 to the total length of reference wires 28. Therefore, the control may be adapted to the different dimensions of machines of different types by simple electronic adjustment devices, such as potentiometers, which are adjusted to the respective ratios. When the illustrated control is used in connection with a continuously advancing machine, as shown herein, wherein the distances between level sensors 33 advancing intermittently with subframe 16 and track sensing elements 29 and 30 advancing continuously with main machine frame 8 change constantly, the magnitude of the adjustment of the electrical zero point of the level sensors may be adapted constantly to the changing distance ratios. There is the additional effect of steadying the reference system inclusive of the leveling control because the forward and rear track sensing elements on machine frame 8, together with their relatively sensitive cross level sensing elements, are not subjected to the vibrations and impacts produced by the operating tools on intermittently advancing subframe 16.

The operation of the hereinabove described control circuit will partly be obvious from the description of its structure and will be further elucidated hereinafter.

It is assumed that there is a residual error in the cross elevation of the leveled track, due to an unexpected settling of track rail 5 which has been lifted by track lifting and lining assembly 22 to a desired superelevation. In view of this settling of track rail 5, whose showing has been exaggerated in the drawing for the sake of illustration, actual superelevation 60 at rear track sensing element 30 is less than desired superelevation 43, the difference between the desired and actual superelevations constituting the residual error. Accordingly, rear end point 61 of reference line 28 associated with track rail 5 assumes a lower, incorrect position compared to the desired track grade, which is indicated at 62. This causes the vertical position of the reference line in the range of associated level sensor 33 to deviate correspondingly from the desired level indicated in broken lines, this deviation corresponding to residual error 62 reduced in the ratio of the distance between level sensor 33 and forward reference line end 45 to the total length of reference line 28. Accordingly, the reference wire engaged in fork-shaped wire sensing element 34 of level sensor 33 would, as shown in FIG. 2, pivot the sensing element down to the level of the erroneously positioned reference wire. This would cause the next lifting stroke imparted to track rail 5 through level sensor 33, control unit 55 and servo valve 56 to be prematurely terminated, thus causing a residual cross level error in the leveled track.

This is avoided by the apparatus of the invention because this residual cross level error is detected by cross level measuring element 46 at rear track sensing element 30, which generates a corresponding error signal and transmits it to unit 50 where it is compared with the desired cross level at this track point. In the indicated position of selection switch 51, this value is transmitted from computer 53 in synchronism with the advance of the machine along the track. The output signal of unit 50 is transmitted through switch 49 to control unit 55 associated with rail 5 so that the electrical zero point of level sensor 33 connected to control unit 55 is automatically corrected. The correction corresponds to the incorrect vertical position of reference line 28 and the resultant erroneous angular position of reference wire sensing element 34, which would cause the subsequent leveling error. This purely electronic zero point correction causes level sensor 33 to act as though its reference wire sensing element 34 engaged the reference line at an imaginary level corresponding to the desired level shown in broken lines. Therefore, lifting drive 23 associated with track rail 5 ceases to operate at the exact moment when the rail has reached the level corresponding to desired superelevation 43.

In track leveling, lining and tamping machines advancing intermittently from tamping cycle to tamping cycle, the ratio of the distance between level sensor 33 and forward end 45 of reference line 28 to the total length of the reference line has a constant magnitude depending on the arrangement of leveling control 14. In non-stop operating machines, as herein illustrated, this ratio depends on the relative movements between intermittently advancing subframe 16 and continuously advancing main machine frame 8. To obtain a zero point correction of level sensor 33 independent of these relative movements, a measuring element which constantly adapts the correction values to the variable distance ratios, such as a cable-operated potentiometer, is integrated in the electronic control circuit of leveling control 14.

It will be clearly understood by those skilled in the art that the control system of this invention may also be used for surfacing tangent tracks without superelevation. Also, it may be used in machines where the rear ends of the reference wires are also vertically adjustable. The drives for this vertical adjustment are deactivated during the operation but may be used intermittently for the occasional re-adjustment of the reference line position.

What is claimed is:

1. A mobile apparatus for correcting the grade and cross level of a track having two rails, the apparatus being arranged for mobility along the track in an operating direction from successive corrected track sections to uncorrected track sections to be corrected, which comprises (a) a track lifting assembly including tools for engaging and lifting the track rails and a respective lifting drive connected to the tools and associated with each track rail, (b) a leveling reference system associated with the track lifting assembly, the reference system including (1) a reference line associated with each track rail, each reference line having a forward end and a rear end, in the operating direction, (2) a forward track sensing element supporting the forward end of the reference lines in a respective one of the uncorrected track sections, (3) a rear track sensing element supporting the rear end of the reference lines in a respective one of the corrected track sections, and (4) a level sensor associated with each track rail and supported on a respective one of the corrected track sections rearwardly of the track rail engaging and lifting tools for measuring the level of each track rail with respect to the associated reference line, the level sensor generating a control signal responsive to the measured level, (c) an element for measuring the cross level mounted on each track sensing element, each cross level measuring element generating an output signal responsive to the measured level, (d) a respective vertical adjustment drive associated with each forward end of a respective one of the reference lines for vertically adjusting each forward end, (e) a respective signal difference forming unit having one input receiving the output signal of the forward cross level measuring element and another input receiving signal corresponding to a desired superelevation of the associated track rail, the unit emitting a signal corresponding to the difference between the input signals to an associated one of the vertical adjustment drives, (f) a further signal difference forming unit having one input receiving the output signal of the rear cross level measuring element and another input receiving a signal corresponding to a desired cross level at the rear cross level measuring element, the further unit generating a correction signal corresponding to the difference between the input signals, and (g) a leveling control receiving the control signal and the correction signal, the control actuating the lifting drives in response to said signals.

2. The mobile apparatus of claim 1, wherein the reference lines are reference wires and the leveling control comprises an electrical control circuit including the reference wires, the control circuit further comprising the further signal difference forming unit, said unit and the level sensors being connected to the leveling control and the control being adjustable to an electrical zero point.

3. The mobile apparatus of claim 2, wherein the level sensors are rotary potentiometers comprising forked sensing elements arranged to contact the reference wires.

4. The mobile apparatus of claim 2, wherein the leveling control has two inputs selectively receiving the correction signal for lifting the respective track rail.

5. The mobile apparatus of claim 4, wherein the cross level measuring element is an electronic pendulum.

6. The mobile apparatus of claim 4, further comprising a manually operable signal input device and a computer wherein the desired cross level values of the successive track sections difference forming unit being selectively connectable to the signal input device and the computer.

7. The mobile apparatus of claim 2, wherein the track lifting assembly includes tools for engaging and laterally shifting the track rails and drive means for operating the track rail shifting tools, further comprising frame means mounted on front and rear undercarriages for mobility along the track, the track lifting assembly being mounted on the frame means, track tamping means mounted on the frame means, the apparatus being a mobile track leveling, lining and tamping machine, the rear track sensing element equipped with the cross level measuring element being arranged in the range of the rear undercarriage, and the magnitude of the adjustment of the electrical zero point of the level sensors corresponding to a residual cross level error is reduced in the same ratio as the ratio of the distance of the level sensor to the forward track sensing element to the total length of the reference wires.

* * * * *